US005263237A

United States Patent [19]

Gallant et al.

[11] Patent Number: 5,263,237

[45] Date of Patent: Nov. 23, 1993

[54] METHOD FOR RESTORING PUNCH AND DIE ALIGNMENT OF A TURRET-TYPE PUNCH PRESS MACHINE

[76] Inventors: Donald A. Gallant, 232 Middleton Dr., Charlotte, N.C. 28207; Gregory R. Eckard, 729 Fredricksburg, Matthews, N.C. 28105

[21] Appl. No.: 936,356

[22] Filed: Aug. 26, 1992

[51] Int. Cl.[5] ..... B23P 6/00; B26D 5/08

[52] U.S. Cl. ..... 29/402.06; 29/402.11; 29/402.19; 83/552

[58] Field of Search ..... 29/35.5, 36, 39, 48.5 R, 29/56.5, 402.03, 402.06, 402.08, 402.9, 402.11, 402.12, 402.14, 402.19, 271; 72/404, 442, 472; 83/552, 556, 559, 640, 554

[56] References Cited

U.S. PATENT DOCUMENTS

| | | | |
|---|---|---|---|
| 4,343,210 | 8/1982 | Kuroyone | 83/552 X |
| 4,380,182 | 4/1983 | Bredow et al. | 83/552 X |
| 4,412,469 | 11/1983 | Hirata et al. | 83/552 |
| 4,532,845 | 8/1985 | Jinnouchi | 83/559 X |
| 4,658,688 | 8/1987 | Shah et al. | 83/556 X |

*Primary Examiner*—Mark Rosenbaum
*Assistant Examiner*—Peter Dungba Vo
*Attorney, Agent, or Firm*—Shefte, Pinckney & Sawyer

[57] ABSTRACT

A method for restoring the alignment of the apertures of the upper and lower turrets of a punch press machine includes the steps of determining the radial and angular misalignment, if any, of an individual turret aperture relative to a reference axis such as, for example, the axis of rotation of the turrets. Any angular misalignment of a turret aperture relative to the reference axis is corrected by re-positioning the respective index pin assembly which maintains the turret in a predetermined angular position. Any radial misalignment of the turret aperture is corrected by a re-boring procedure in which a cutting tool supported on a boring bar is advanced through the turret at the area of the respective aperture to re-bore the aperture to a new, enlarged diameter with the walls of the aperture being concentric with an axis at the desired radial spacing from the reference axis. A preferred cutting tool for use in the re-boring procedure includes three cutting tips, each supported at a different radial spacing from the axis of the cutting tool. A cylindrical sleeve insert can be optionally installed in a newly enlarged turret aperture with the cylindrical sleeve insert having an inside diameter corresponding to the outside diameter of a respective punch holder normally supported in the turret aperture.

7 Claims, 9 Drawing Sheets

METHOD FOR RESTORING PUNCH AND DIE ALIGNMENT OF A TURRET-TYPE PUNCH PRESS MACHINE

BACKGROUND OF THE INVENTION

The present invention relates to a method for restoring punch and die alignment of a turret-type punch press machine and a cutting tool and sleeve insert for use in the method.

A well known type of punch press machine includes an upper circular turret and a lower circular turret, both co-axially mounted for rotation about a common axis of rotation and each having a plurality of angularly spaced apertures. The apertures of the upper turret each support a punch holder in which a punch is supported for axial movement. The apertures of the lower turret each support a die (which is typically supported on a die holder mounted at the aperture). An axially movable ram is disposed above the upper turret at the same radial spacing as the upper turret apertures and is operable to reciprocally axially move a punch holder supported at a respective upper turret aperture into punching engagement with a workpiece supported on a die of the lower turret aligned with the punch.

A punching operation thus requires alignment among the respective die of the lower turret, the respective punch of the upper turret, and the ram. However, several commonly occurring conditions combine to degrade this alignment and thereby impair the efficiency of the punch press machine. Each upper turret aperture typically includes a radially movable, spring biased pin which maintains the punch holder in its topmost position within the aperture. The axial movement of the punch holder cyclically applies a radial force to the pin, whereupon the spring biasing force increases to a relatively marked degree, and the portion opposite of the aperture in which the spring biased pin is disposed is subjected to considerable wear.

The axial motion of the punch holder also imparts wear forces on the aperture. Also, when a punch operation involves "nibbling"—e.g., the progressive punching of a workpiece to make a larger hole therein—wear occurs randomly on the surface of the punch holder and this contributes to wear on the aperture. Moreover, on punch press machines equipped for plasma torch burning of large holes, a by-product of such burning is the accumulation of a significant amount of slag of a highly abrasive nature. The slag, as well as oil or other lubricant on the top of the turret, tends to flow into the aperture in the space between the punch holder and the walls of the aperture, whereupon the rate of wear of the aperture is accelerated.

Yet a further reason for wear on the aperture of a turret is imprecise engagement of a turret by an assembly which maintains the turret at a predetermined angular position in which the respective punch supported by the turret is aligned with the ram. Typically, such an assembly includes a pressurized cylinder-actuated index pin which is extended radially inwardly toward the turret to engage a corresponding index aperture in the circumferential surface of the turret. If the respective circumferential aperture of the turret is not precisely aligned with the index pin when the pin is driven radially inwardly, the index pin is not inserted cleanly into the circumferential aperture but is, instead, driven with relatively significant side thrust force against the turret. This produces a backlash force on the pressurized cylinder supporting the index pin and leads to a loosening of the mounting of the pressurized cylinder on the machine frame. Thus, while it is possible for an index pin to still engage a circumferential aperture to thereby maintain the turret in a fixed angular position, the loosened condition of the pressurized cylinder, as well as wear on the circumferential aperture, leads to angular misalignment among the ram, punch and die. Typically, the upper turret is more massive than the lower turret and correspondingly larger force is required to precisely position the upper turret, whereby the severity of angular misalignment due to a loosened pressurized index pin cylinder is more pronounced with respect to the upper turret and its associated index pin assembly than the lower turret. Accordingly, the need exists for a method for efficiently and precisely restoring the punch and die alignment of a punch press machine.

SUMMARY OF THE INVENTION

Briefly described, the present invention provides, in one aspect thereof, a method for aligning the apertures of the turrets of a punch press machine, the punch press machine being of the type having a rotatable lower turret with a plurality of angularly spaced, through apertures each for supporting a die holder, a rotatable upper turret co-axial with the rotation axis of the lower turret and having a plurality of angularly spaced, through apertures each for receiving a punch holder therein, each punch holder supporting an axially movable punch and each die holder for supporting a die on which a workpiece is disposed for a punching operation, means for releasably maintaining a turret in a predetermined angular position, and a ram for axially driving a punch supported at an upper turret aperture into contact with a workpiece disposed on the die of a lower turret aperture generally aligned with the upper turret aperture.

The method includes the steps of detecting the difference, if any, between the radial spacing of the axis of a turret aperture and a predetermined radial spacing as measured from a reference axis and detecting the difference, if any, between the angular position of the turret aperture axis and a predetermined angular position as measured relative to the reference axis. Also, if any angular difference of the turret aperture axis is detected, the method includes the step of adjusting the releasably maintaining means to maintain the turret having the detected turret aperture at a predetermined angular position in which the detected angular difference is reduced to a predetermined value. Additionally, if any radial spacing difference is detected, the method includes the step of enlarging the circumference of the detected turret aperture to an enlarged circumference whose axis lies substantially at the predetermined radial spacing.

According to one feature of the method of the present invention, if the turret includes a registration location correlated with the detected aperture, the turret registration location being in registry with a selected angular reference location upon substantial coincidence with the turret aperture axis with the predetermined angular position, and the releasably maintaining means includes means for selectively engaging the turret, the adjusting the releasably maintaining means includes adjusting the selectively engaging means to engage the turret so as to maintain the registration location in registry with the predetermined angular reference location.

In one detail of the one feature of the method of the present invention, the selectively engaging means includes a member extendable radially inwardly to engage the turret and retractable radially outwardly to release the turret for further rotation and the adjusting the selectively engaging means includes changing the angular position of the member.

According to another feature of the method of the present invention, enlarging the detected turret aperture includes disposing a first guide bearing in the ram aperture, disposing a second guide bearing in the respective turret not having the detected turret aperture, mounting a boring bar in the first and second guide bearings for guided rotational movement of the boring bar by the guide bearings, the boring bar being operable to support a cutting tool for a cutting operation in which material is removed from the turret having the detected turret aperture by the cutting tool moving relatively along the surface forming the detected turret aperture, and rotationally driving the boring bar to effect cutting of the turret by the cutting tool.

In the another feature of the method of the present invention, the method optionally includes disposing a cylindrical sleeve in the enlarged diameter turret aperture for retaining a punch holder therein. According to one aspect of this optional feature, the detected turret aperture includes a radially outwardly extending keyway for receipt therein of a key formed on a punch holder and the disposing a cylindrical sleeve includes disposing a cylindrical sleeve having a keyway in the enlarged diameter turret aperture with the sleeve keyway in alignment with the turret aperture keyway.

According to a further feature of the method of the present invention, the cutting tool includes a plurality of cutting tips each independently positionable at a predetermined radial spacing from the rotational axis of the boring bar and the method includes setting each cutting tip at a different radial spacing than the other cutting tips prior to rotationally driving the boring bar.

According to another aspect of the present invention, there is provided an apparatus for removing material from a workpiece including a body portion having an axis, a cutting tip, and a cutting tip support for supporting the cutting tip on the body portion. The body portion includes an axially extending support receiving slot for receiving the cutting tip support therein and means for securing the cutting tip support in the slot, the body portion being rotatable about its axis to effect rotary cutting movement of the cutting tip on the workpiece and the support receiving slot including a surface extending between a first location and a second location. The first location is at a first radial spacing from the axis and the second location is spaced axially further from an axial end of the body portion than the first location and at a second radial spacing from the axis greater than the first radial spacing of the first location from the axis. The securing means is operable to selectively secure the cutting tip support on the surface at a first position in which the cutting tip is at a first radial spacing from the axis and a second position on the surface in which the cutting tip is at a greater axial spacing from the one axial end and at a greater radial spacing from the axis than in the first position of the cutting tip support.

Preferably, the securing means includes a hold down member having a plurality of throughbores, and a plurality of bolts and the body portion includes a plurality of threaded bores, each bolt being insertable through a respective throughbore and threadable into a respective threaded bore of the body portion to cooperate with the other bolts in securing the hold down member to the body portion and the hold down member engaging the cutting tip support to releasably fixedly secure the cutting tip support to the body portion.

According to one preferred feature of the cutting tool of the present invention, the hold down member includes a planar surface and the cutting tip support includes a planar surface having an opposite slope in the installed position of the cutting tip support on the body portion than the planar surface of the hold down member, the planar surface of the hold down member engaging the planar surface of the cutting tip support to secure the cutting tip support in the slot. Also, the apparatus may optionally include three or more cutting tips and three or more cutting tip supports each for supporting a cutting tip, the three or more cutting tip supports being secured to the body portion by the securing means at substantially equal circumferential spacings from one another relative to an axis of the body portion.

According to a further aspect of the present invention, there is provided a sleeve insert assembly for the aperture of a turret of a punch press machine having a sleeve insert having a cylindrical body portion for the receipt of a punch holder therein, and means for fixedly securing the sleeve insert in a turret aperture.

According to one feature of the sleeve insert assembly of the present invention, the sleeve insert includes a flange portion formed on one axial end of the cylindrical body portion for supporting the cylindrical body portion on a surface of the turret. Also, as desired, the sleeve insert includes a keyway.

According to another feature of the sleeve insert assembly of the present invention, the fixedly securing means includes at least two tabs each adapted to extend over an axial end of the sleeve insert at a circumferential spacing from the other tab and means for securing each, tab to the turret.

DETAILED DESCRIPTION OF THE PREFERRED EMBODIMENTS

Figure 1:
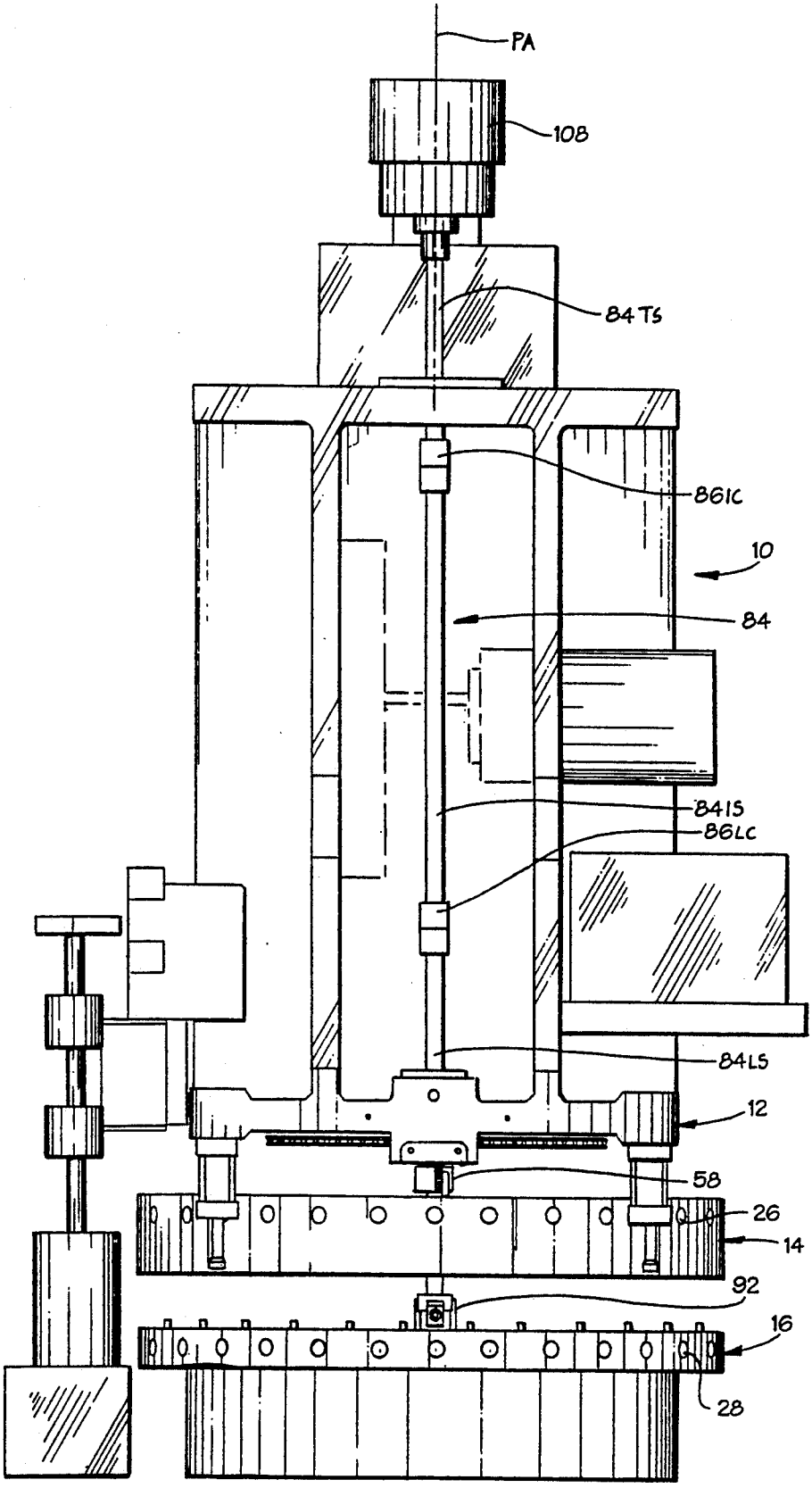
Fig. 1 (PRIOR ART)
FIG. 1 is a front elevational view of a portion of a turret-type punch press machine and showing the cutting tool of the present invention disposed thereon for a cutting operation in accordance with the method of the present invention.
Figure 2:
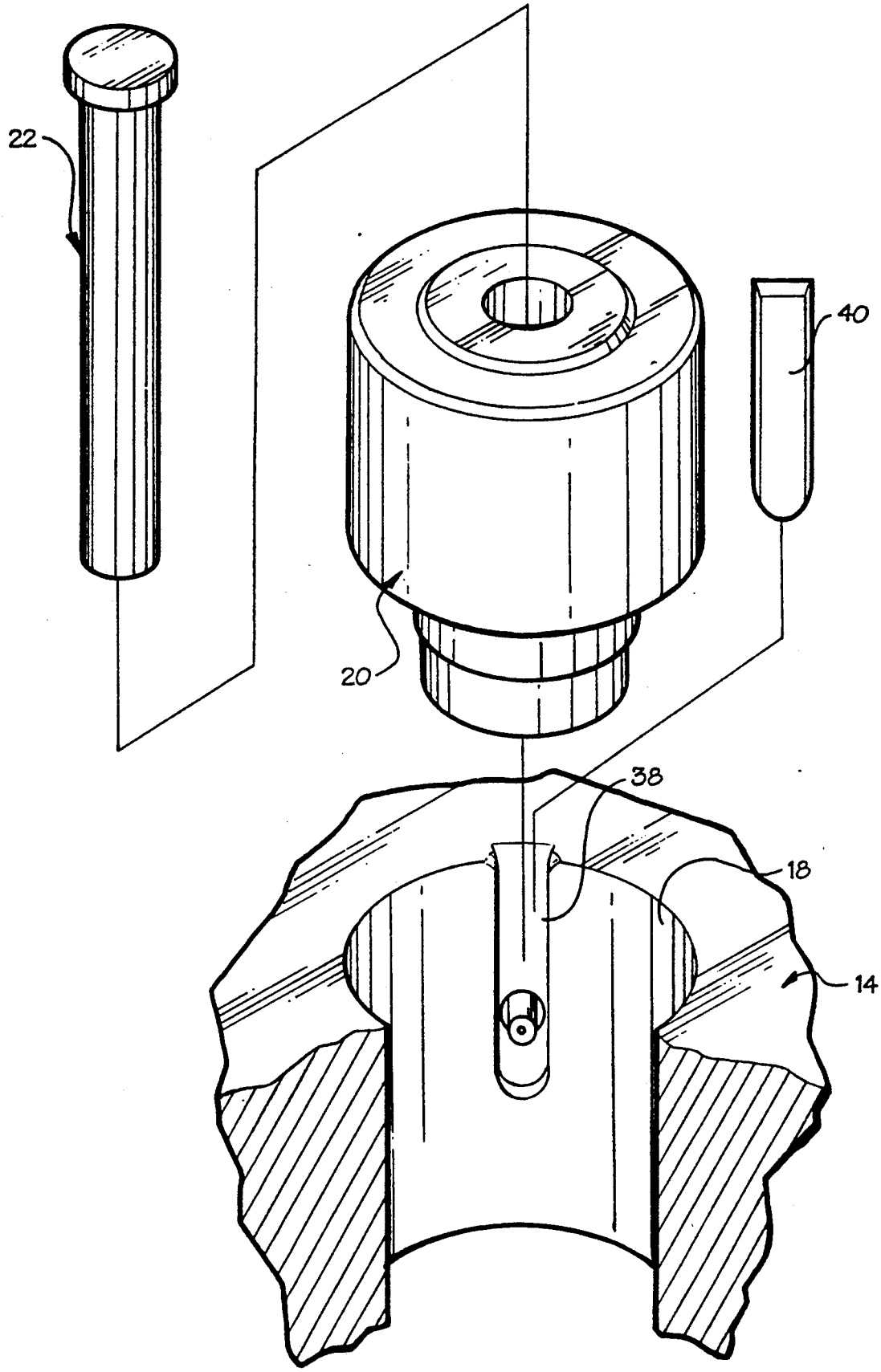
FIG. 2 is an exploded perspective view of a punch tool and its holder and showing, in partial vertical section, a punch tool aperture in the upper turret of the punch press machine shown in FIG. 1.
Figure 3:
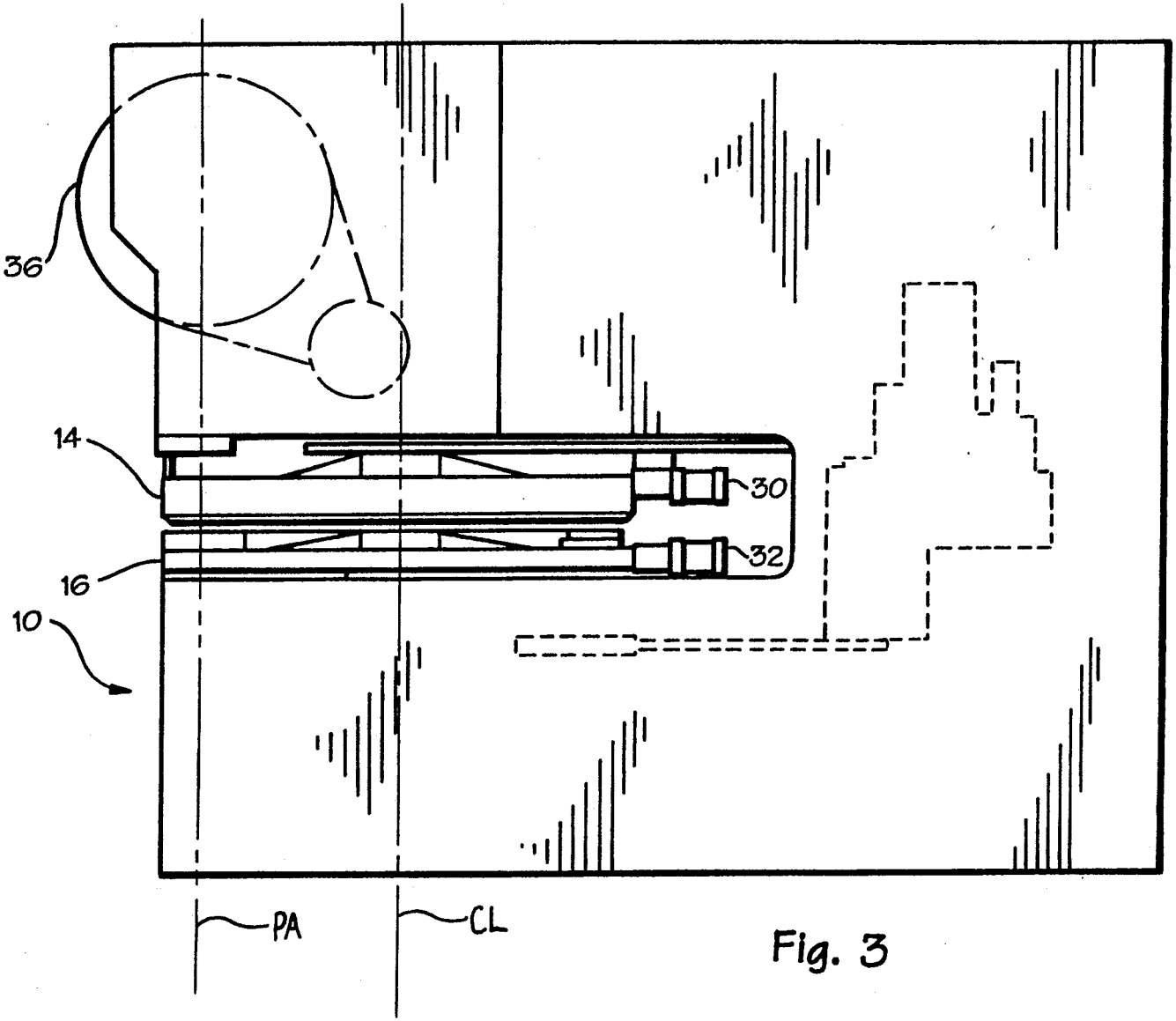
FIG. 3 is a schematic side elevational view of the punch press machine shown in FIG. 1.
Figure 6:
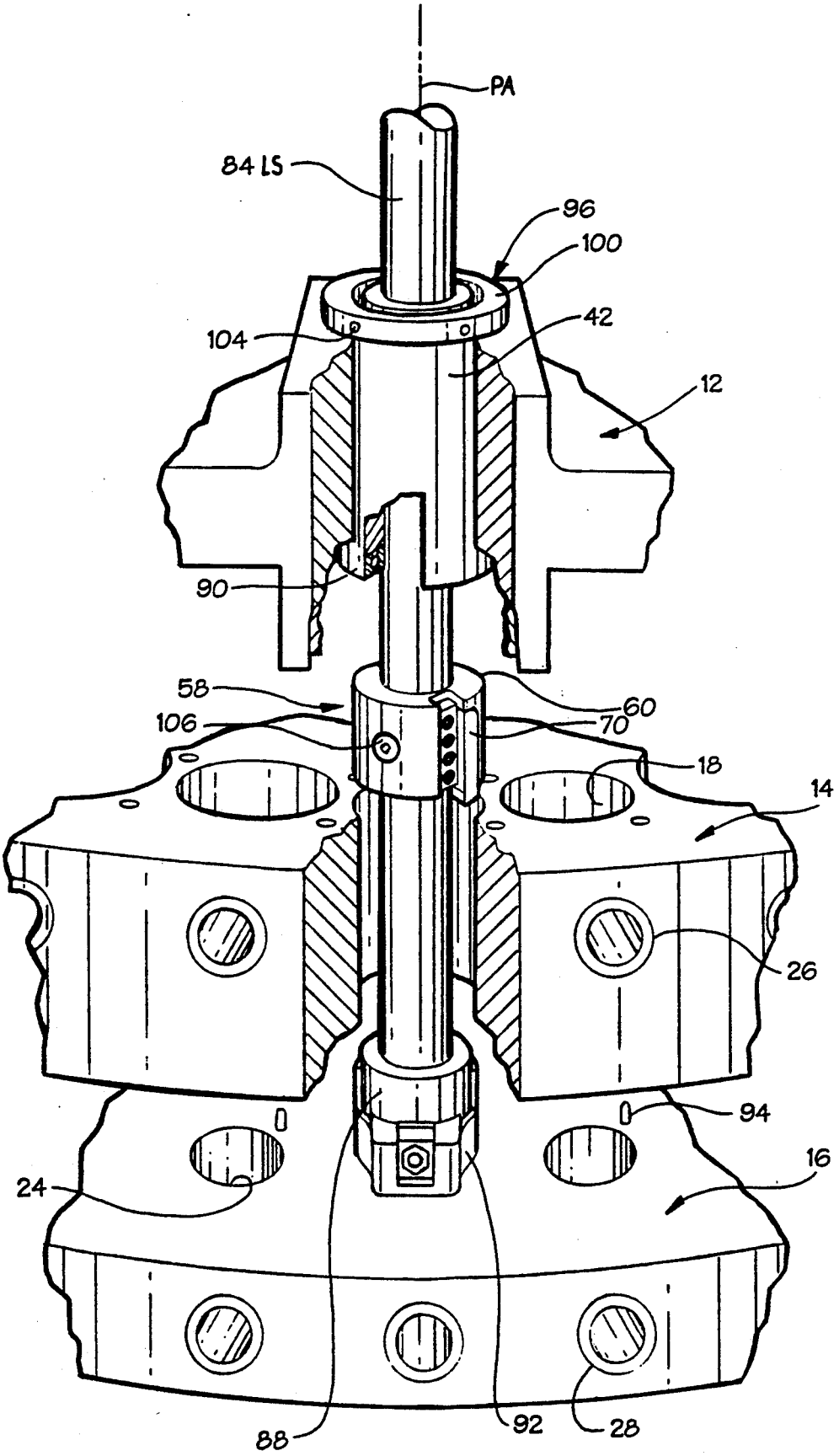
FIG. 6 is an enlarged perspective view, in partial vertical section, of portions of the ram holder, the upper turret, and the lower turret of the punch press machine shown in FIG. 1 and showing, in partial vertical section, the boring bar and cutting tool of the present invention supported by bushings mounted in the ram plate and the lower turret.

In FIGS. 1 and 3, a turret-type punch press machine 10 is schematically illustrated. The punch press machine 10 is of the type which conventionally includes a ram frame 12 having an aperture 12A, as seen in FIG. 6, in which a ram (not shown) is supported by the ram frame, an upper turret 14 and a lower turret 16. As seen in FIG. 6, the upper turret 14 includes a plurality of angularly spaced apertures 18, each typically of a different diameter than the other apertures and adapted to receive a punch tool holder 20, as seen in FIG. 2. Each punch tool holder 20 supports a punch 22 for axial movement of both as a single unit relative to the respective aperture 18. The ram aperture 12A formed in the ram frame 12 is disposed at a predetermined radial spacing from a center line CL the punch press machine 10, as seen in FIG. 3. The upper turret 14 and the lower turret 16 are each rotatably supported on a main frame of the punch press machine 10 for rotation about the center line CL for selective positioning of a respective one of the punches 22 supported in the upper turret 14 with a respective one of the dies supported in the lower turret 16.

The lower turret 16, as seen in FIG. 6, includes a plurality of angularly spaced die apertures 24, each for supporting a die (not shown) which cooperates with a selected punch 22 in a punch press operation in which a workpiece disposed between a die and a respective punch 22 is shaped by repeated impacts from the respective punch 22 as it is driven by the ram. To ensure the most effective punching operation, the respective punch 22 indexed into punching position below the ram should extend axially along a punch axis PA, shown in FIG. 3, which at the same predetermined radial spacing from the center line CL as the axis of the ram and, additionally, the respective die supported by the lower turret 16 should be centered on the punch axis PA. The dies are typically supported on the lower turret 16 by die holders which are secured in fixed positions relative to the apertures 24 and the dies themselves are not axially moved during the punching operation, in contrast to the punches 22. Thus, wear of the type which would lead to undesirable movement of the dies from their centered positions is relatively minimal. However, the apertures 18 in the upper turret 14 are subjected to relatively significant wear which detrimentally permits the punch tool holders 20 and, thus, the punches 22, to shift radially and angularly with respect to the center line CL, thereby resulting in the punches 22 being in off-center positions in which the individual axes of the punches are no longer coincident with the punch axis PA. If a punch 22 or its corresponding cooperating die is in an off-center position, the risk of a less than optimum punching operation is increased and, depending upon the severity of the punch/die misalignment, undesirable deformation of a workpiece undergoing a punching operation can result as well as increased wear and early failure of the punch and die components themselves. The method of the present invention restores the punch/die alignment to a punch press machine. Moreover, the practice of the novel method disclosed herein may be optionally facilitated by the use of a novel cutting tool and a novel sleeve insert, as described in more detail below. Since the method of the present invention can be practiced on a wide number of turret-type punch press machines, the punch press machine 10 is to be understood as representative of any of a variety of turret-type punch press machines suitable for an alignment restoration procedure in accordance with the method of the present invention, although the punch press machine 10 is a schematic representation of a commercially available punch press machine sold by the Wiedemann Corporation under the designation Model W3050.

Figure 4:
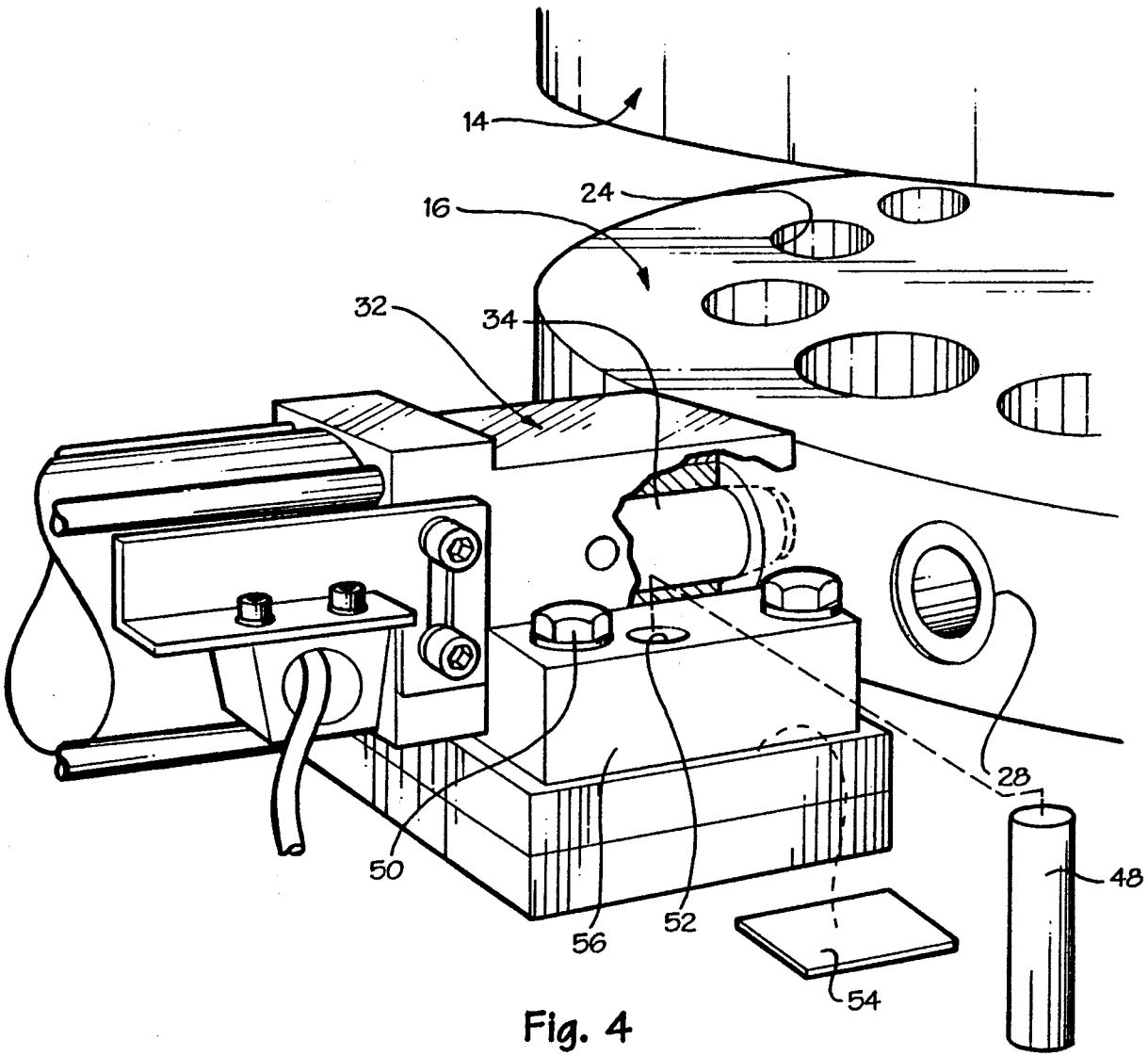
FIG. 4 is an enlarged perspective view, in partial vertical section, of an indexing pin assembly of the punch press machine shown in FIG. 1.

As seen in FIGS. 1 and 6, the upper turret 14 includes a plurality of turret registration locations in the form of a plurality of index apertures 26 angularly spaced about its circumference. The lower turret 16 also includes a plurality of turret registration locations in the form of a plurality of index apertures 28 angularly spaced about its circumference. As seen in FIG. 3, an upper turret index pin assembly 30 is operable to selectively insert an insert pin into one of the index apertures 26 of the upper turret 14 aligned therewith to maintain the upper turret 14 in a selected angular disposition. A lower turret index pin assembly 32, as seen in FIGS. 3 and 4, is operable to insert an index pin 34 into one of the index apertures 28 in registry therewith to maintain the lower turret 16 in a predetermined angular disposition. The index pin 34 is formed as the piston of an air operated cylinder which is actuable through, for example, a four way solenoid valve (not shown) to selectively extend the index pin 34 in a radially inward direction relative to the lower turret 16 into an inserted position in one of its index apertures 28 and to selectively withdraw the index pin 34 to permit angular displacement of the lower turret 16. The upper turret index pin assembly 30 is not illustrated in detail as it is configured and operated essentially identically to the lower turret index pin assembly 32 and this type of index pin assembly is conventionally known. The turret index pin assemblies 30,32 are positioned generally diametrically opposite the ram aperture relative to the center line CL for engaging an index aperture generally diametrically opposed to the respective turret aperture aligned with the ram aperture.

Figure 5:
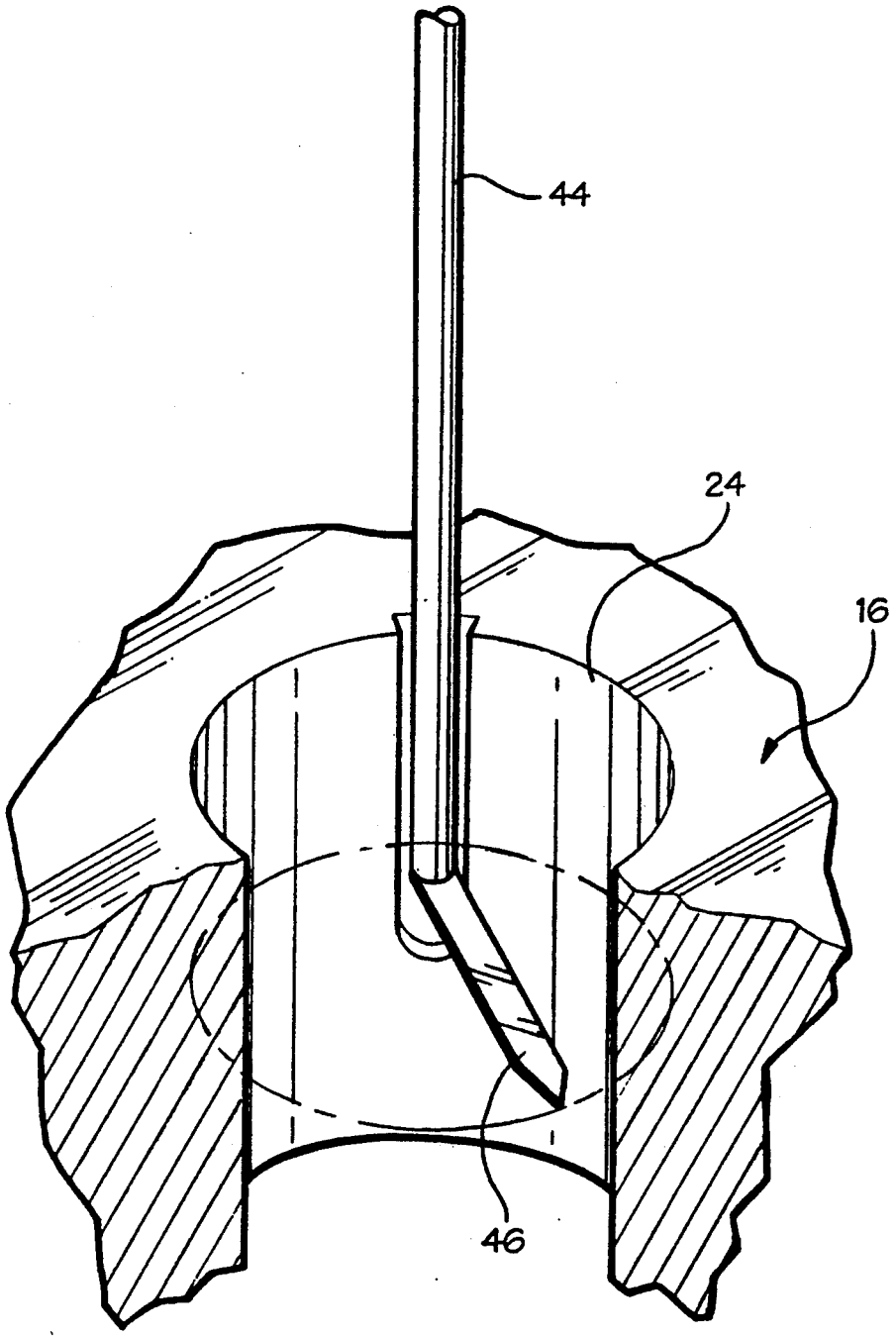
FIG. 5 is an enlarged perspective view, in partial vertical section, of a punch hole of the upper turret of the punch press machine shown in FIG. 1 and schematically showing a circumference measurement gage.

An initial step of the alignment restoration method involves the detection of any misalignment between the upper turret apertures 18 and a reference axis such as, for example, the punch axis PA, as well as the detection of any misalignment between the lower turret apertures 24 and the punch axis PA. The preferred approach for detecting such misalignment is to measure the degree, if any, to which a selected upper turret aperture 18 or lower turret aperture 24 is displaced from a co-axial orientation with the punch axis PA and, to prepare for such measurement, it is typically necessary to remove the crank and Pittman, schematically shown as 36 in FIG. 3, as well as to remove the ram and the ram bushing (not shown) which supports the ram for axial movement in the ram aperture of the ram frame 12. Also, the punch tool holders 20 are removed from the upper turret 14 and the die holders (not shown) which support the dies in the lower turret 16 are likewise removed. As seen in FIGS. 2 and 5, the removal of the punch tool holder 20 from its associated upper turret aperture 18 leaves the original, factory-cut aperture exposed. The aperture may include a keyway 38 for receiving a key 40 formed on each punch tool holder 20 to ensure proper seating of the punch tool holder in its respective upper turret aperture 18 as well as to prevent angular movement of holder 20.

After removal of the ram bushing, a first guide bearing or bushing 42 is mounted in the aperture in the ram frame 12 which previously supported the now-removed ram bushing and the ram and the bushing 42 supports a gage rod 44, as seen in FIG. 5, at the free end of which is a dial indicator 46. An appropriate securement means such as, for example, a supporting collar (not shown) is secured to the top of the gage rod 44 to secure the gage rod in the bushing 42 in a manner which permits axial and angular movement of the dial indicator 46 while preventing radial movement of the gage rod 44. The dial indicator 46 is supported at a location axially intermediate the respective upper turret aperture 18 or lower turret aperture 24 to be measured and the tip of the dial indicator 46 is "swept", or rotated, to provide an indication of the direction and magnitude of the misalignment, if any, of the respective aperture relative to the punch axis PA. During this measurement procedure, the respective turret being measured is locked against angular movement by, for example, insertion of the index pin of its respective index pin assembly into one of the circumferential apertures 26,28.

The dial indicator 46 may indicate that the center line of the respective turret aperture is angularly displaced from the punch axis PA (angular misalignment), radially displaced from the punch axis PA (radial misalignment), or is both angularly and radially misaligned. The respective type (angular or radial) of misalignment and its magnitude (as measured, for example, in degrees or linear units) is recorded for later reference.

If any angular misalignment is detected between the measured upper or lower turret aperture and the punch axis PA, the following procedure is implemented to restore angular alignment of the respective aperture. To continue with the example in which a selected one of the lower turret apertures 24 is the measured aperture, as seen in FIG. 5, the procedure includes the step of repositioning the lower turret index pin assembly 32 relative to the main frame of the punch press machine 10 to effect adjustment in the angular position of the lower turret aperture 24. For example, if the lower turret index pin assembly 32 is mounted to the main frame by an arrangement including a plurality of alignment dowels 48 (one of which is shown in FIG. 4) and a plurality of bolts 50 threadably received in the main frame, the repositioning of the turret index pin assembly can be accomplished by enlargement of the dowel holes 52 for receiving the dowels and/or the provision of alignment dowels of a larger diameter. Additionally, one or more shims 54 may be positioned between the turret index pin assembly and the main frame of the punch press machine 10, with the goal of the repositioning of the turret index turret assembly being an adjustment of the orientation at which the index pin 34 is extended from the index pin assembly into the respective circumferential aperture 28 aligned therewith.

The procedure for replacing an alignment dowel 48 with a larger alignment dowel involves removal of the original alignment dowel 48 from its dowel hole 52 and removal of the bolts 50 to permit removal of the lower turret index pin assembly 32 from the main frame of the punch press machine 10. Then, the dowel hole 52, which is formed by an upper portion extending completely through a flange 56 of the lower turret index pin assembly 32 and a lower portion extending into the main frame, is reamed by a conventional reaming method to enlarge the dowel hole to a larger diameter. Following reaming of the dowel hole 52, the lower turret index pin assembly 32 is again mounted to the main frame by re-installing the bolts 50 and a larger diameter alignment dowel 48 of a diameter corresponding to the newly enlarged dowel hole 52 is inserted in the dowel hole.

The height of the lower turret index pin assembly 32 relative to the main frame is adjusted by inserting one or more of the shims 54 between the bottom surface of the flange 56 and the main frame. The extent to which the height of the lower turret index pin assembly 32 and the re-reaming of the dowel hole 52 is undertaken is dependent upon the degree of adjustment necessary to adjust the index pin 34 so that, upon full insertion, the index pin 34 in the circumferential aperture 28, the measured lower turret aperture 24 is angularly aligned with the punch axis PA.

The elimination of any angular misalignment of a measured upper turret aperture 18 is performed in the same manner as described above with respect to the lower turret index pin assembly 32 in that the upper turret index pin assembly 30 is repositioned on the main frame of the punch press machine 10 as necessary. During the repositioning of one of the index pin assemblies 30,32, it may be necessary to again "sweep" or rotate the dial indicator 46 in the respective upper or lower turret aperture 18,24 to determine the need for further repositioning of the index pin assembly.

Once the measured lower turret aperture 24 has been brought into angular alignment with the punch axis PA through the index pin assembly repositioning procedure described above, the detected radial misalignment of the aperture, if any, is corrected by an aperture re-boring procedure as follows. In this exemplary aperture re-boring procedure, it is assumed that the respective measured aperture is one of the upper turret apertures 18 and that the gage measurement procedure has determined that the upper turret aperture is radially misaligned with the punch axis PA—e.g., the center line or axis of the upper turret aperture is at a lesser radial spacing from the center line CL than the punch axis PA or, alternatively, the center line or axis of the upper turret aperture is at a greater radial spacing from the center line CL than the punch axis PA. The re-boring of the upper turret aperture 18 is accomplished by a novel cutting tool 58, the details of which can be seen in particular in FIGS. 8A and 8B. With reference to those figures, the cutting tool 58 comprises a cutter holder 60 having a cylindrical inner bore 62 and an outer circumferential surface 64 comprised of three or more arcuate segments each circumferentially separated from the adjacent arcuate segments by a radially extending combined tool support and tool support holder slot 66.

The length of the cutter holder 60 is slightly less than the axial spacing between the ram frame 12 and the upper turret 14. The diameter of the outer circumferential surface 64 of the cutter holder 60 is slightly less than the new enlarged diameter to which the upper turret aperture 18 is to be re-bored by the cutting tool 58.

Figure 8A:
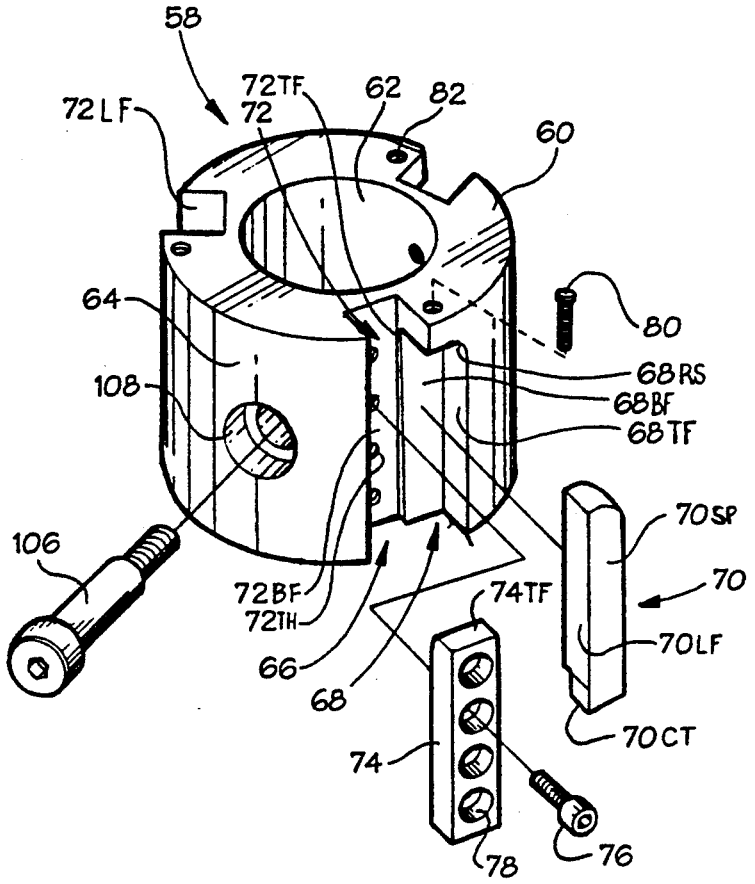
FIG. 8A is an enlarged perspective view of the cutting tool of the present invention showing the cutting tip and cutting tip holder in unassembled condition.

With reference to FIG. 8A, each slot 66 is formed with a tool support receiving region 68 for receiving a tool support 70 therein and a holder region 72 for receiving a holder 74 therein. Each tool support receiving region 68 is formed by a trailing face 68TF extending radially inwardly from the respective arcuate segment of the outer circumferential surface 64 to an extent less than the radial spacing between the inner bore 62 and the outer circumferential surface 64. Additionally, each trailing face 68TF extends axially from the bottom surface of the cutter holder 62 to a radiused surface 68RS axially below the top surface of the cutter holder. Each tool support receiving region 68 is also formed by a bottom face 68BF extending axially from the bottom surface of the cutter holder 60 to generally the same axial height as the radiused surface 68RS. The bottom face 68BF is planar and is inclined radially outwardly in a direction from its top edge to its bottom edge. The bottom face 68BF of each tube support receiving region 68 is perpendicular to the adjacent trailing face 68TF.

With regard to FIG. 8A, each holder receiving region 72 is formed by a bottom face 72BF extending from the bottom surface of the cutter holder 60 to its top surface along a plane parallel to the axis of the cutter holder 60. Each bottom face 72BF includes a plurality of radially extending threaded holes 72TH, each for threadably receiving a bolt 76 inserted through a throughbore 78 in a holder 74 to secure the holder 74 in the holder receiving region 72. The bottom face 72BF of each holder receiving region 72 is at a lesser radial spacing from the center line of the cutter holder 60 than the uppermost edge of the adjacent bottom face 68BF, which is the radially innermost portion of the bottom face. Thus, a planar trailing face 72TF is formed between the bottom face 72BF of each holder receiving region 72 and the adjacent bottom face 68BF. Each holder receiving region 72 is also formed, on one side, by a leading face 72LF which extends radially inwardly from an arcuate segment of the circumferential surface 64 to an edge contiguous with the bottom face 72BF. Each leading face 72LF is parallel to the trailing face 68TF of the associated tool support receiving region 68.

As seen in FIG. 8A, each tool support 70 includes a cutting tip 70CT formed at a lower axial end thereof and a shank portion 70SP having a front face and a back face. The back face of the shank portion 70SP is of a greater width than the front face of the shank portion and has a width extent generally equal to the width extent of the bottom face 68BF of a tool support receiving region 68. The leading surface 70LS of the tool support 70 forms an outward angle of approximately 5° to a radial plane in the installed position of the tool support. The top surface of the shank portion 70SP is formed with a radiused corner of the same radius as the radius surface 68RS of a tool support receiving region 68.

As further seen in FIG. 8A, each holder 74 is formed with a bottom face of lesser width than its front face, the width of the bottom face being generally the same as the width extent of the bottom face 72BF of a holder receiving region 72. Also, each holder 74 has a planar beveled trailing face 74TF which forms an inward angle of approximately 5° to a radial plane in the installed position of the holder in its respective holder receiving region 66. A set screw 80 is threadably received in a set screw bore 82 for adjustably positioning a respective tool support 70 in a tool support receiving region 68, as described in more detail below.

Figure 8B:
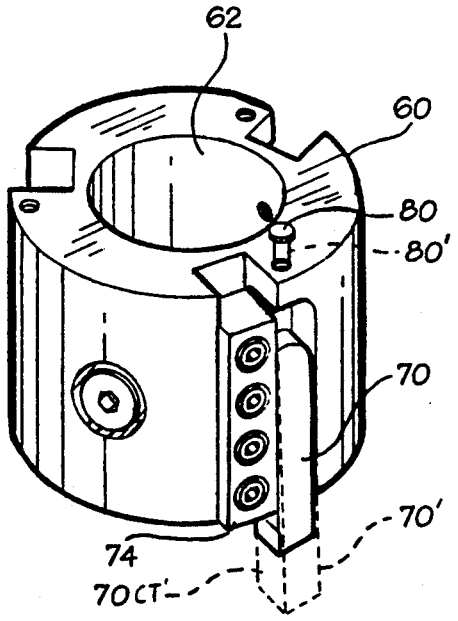
FIG. 8B is a perspective view of the cutting tool shown in FIG. 8A and showing the cutting tip and the cutting tip holder in their assembled positions.

As seen in FIG. 8B, each tool support 70 is removably secured in one of the tool support receiving regions 68 by clamping or compressive gripping of the tool support between one of the holders 74 and the trailing face 68TF. Each holder 74 is secured within one of the holder receiving regions 72 by threading engagement between the bolts 76 and the thread holes 72TH of the respective holder receiving region. Each tool support 70 is oriented with its radiused corner positioned toward the radius surface 68RS of the respective tool support receiving region 68 and the set screw 80 is threaded through its set screw bore 82 to engage the top surface of the tool support 70. The trailing face 74TF of each holder 74 engages the adjacent side face of the shank portion 70SP of the associated tool support 70 and, due to the opposite slope of the surfaces 74TF and 70LF, the holder 74 engages the tool support 70 in cooperation with the trailing face 68TF to removably retain the tool support in the respective tool support receiving region 68.

Since the bottom face 68BF tapers radially outwardly in the direction from the top surface toward the bottom surface of the cutter holder 60, the cutting tip 70CT extends to progressively greater radially outward positions in correspondence with adjustable positioning of the tool support 70 at increasing distances from the top surface of the cutter holder 60. The extent to which the lower free end of the set screw 80 extends axially below the top surface of the cutter holder 60 determines the axial position of the tool support 70 and, thus, the radially outward position of the cutting top 70CT. For example, as seen in FIG. 8B, when the set screw 80 is threaded approximately half its length downwardly beyond the set screw bore 82, as seen in the solid line position, the top surface of the tool support 70 is engaged by the lower free end of the set screw 80 and maintained at a spacing from the radius surface 68RS. In this solid line position of the tool support 70, the cutting tip 70CT is at a first predetermined radial spacing from the center line of the cutter holder 60. On the other hand, when the set screw 80 is further threaded along the set screw bore 82 so as to increase the axial distance between the lower free end of the set screw and the top surface of the cutter holder 60, the set screw, which is in the position shown by the broken lines 80', maintains the tool support 70, which is in the position shown by the broken line 70', at a further axial spacing from the top surface of the cutter holder 60 than the axial position of the tool support 70 described with respect to the solid lines in FIG. 8B. In this second position at which the top surface of the tool support 70 is maintained by the set screw 80 at an increased axial spacing from the top surface of the cutter holder 60, the cutting tip 70CT is positioned at a greater predetermined radial spacing from the center line of the cutter holder 60 than the first predetermined radial spacing described above (the second, more radially outward position of the cutting tip is indicated at 70CT' in FIG. 8B).

Due to the beveled or angled trailing face of the holder 74 and its complementary relationship with the beveled or angled leading face of the tool support 70, the tool support 70 can be readily axially displaced along the tool support receiving region 68 by movement of the set screw 80 while the holder 74 cooperates with the trailing face 68TF to prevent radial withdrawal of the tool support 70. During positioning of the tool support 70 in the tool support receiving region 68, the bolts 76 are preferably not fully tightened down but, instead, are tightened only to the degree necessary to maintain the holder 74 in a generally loose radial retaining relationship with the tool support 70. Once the tool support 70 has been adjusted to its desired axial position, the bolts 76 can be fully tightened down such that the beveled or angled trailing face of the holder 74 and the trailing face 68TF compressively grip the tool support 70 therebetween and thereby prevent axial, radial, or angular movement of the tool support.

The cutting tool 58 provides particularly advantageous cutting action during a re-boring procedure in which one of the turret apertures 18,24 are re-bored to a larger diameter. As seen in FIGS. 1 and 6, an assembly is provided for supporting the cutting tool 58 in cutting relationship to the respective upper turret 14 or lower turret 16 during cutting of an aperture thereat and this support assembly includes a boring bar 84 supported by a plurality of bushings on the main frame of the punch press machine 10, the ram frame 12, and the respective turret 14,16 not undergoing a re boring procedure. The boring bar 84 includes a lower shaft portion 84LS coupled by a lower shaft coupling 86LC to an intermediate shaft portion 84IS which, in turn, is coupled by an intermediate shaft coupling 86IS to a top shaft portion 84TS, as seen in FIG. 1. As seen in FIG. 6, the lower shaft portion 84LS, which is a cylindrical shaft, is extended through a bushing disposed in the ram aperture of the ram frame 12 such as, for example, the bushing 42 previously described with respect to the dial indicator measurement procedure and the bottom free end of the lower shaft portion 84LS is either supported by a bushing (not shown) disposed in an upper turret aperture 18 in the upper turret 14 (in the event that a lower turret aperture 24 is to be re-bored) or is supported a bushing insert 88 mounted on a die holder associated with a lower turret aperture 24 (in the event that an upper turret aperture 18 is to be re-bored). The bushing 42 in the ram frame 12 and the bushing in the upper turret 14 or the bushing insert 88 in the lower turret 16 support the lower shaft portion 84LS of the boring bar 84 for rotation about the punch axis PA as well as permitting axial movement of the boring bar while preventing radial movement of the boring bar. The cutting tool 58 is fixedly secured to the boring bar intermediate the bushing 42 in the ram frame 12 and the other bushing or bushing insert 88, as described in more detail below.

As seen in FIG. 6, the bushing 42 includes a bearing assembly 90 at its lower axial end adjacent the lower end of the ram aperture. The bushing insert 88 includes a similar bearing assembly (not shown) adjacent its upper axial end for rotatably supporting the lower shaft portion 84LS in the bushing insert. The bushing insert 88 is preferably configured to be mounted in a convention die holder 92 such as, for example, a die holder of the type having a positioning bore (not shown) for receiving a projection 94 extending upwardly the respective lower turret aperture 24 at which the die holder is disposed.

Figure 7:
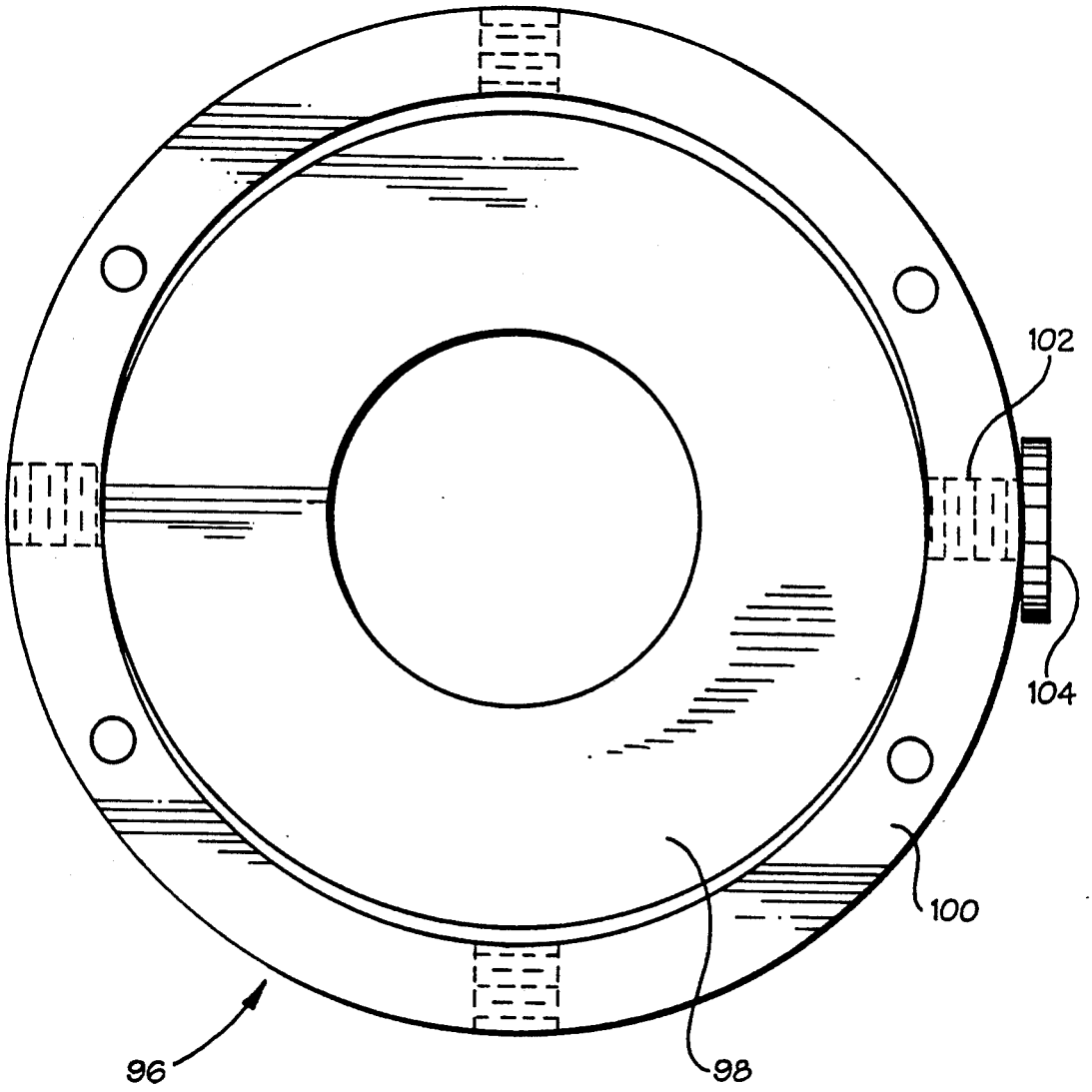
FIG. 7 is an enlarged top plan view of the ram plate bushing for supporting the boring bar shown in FIG. 6.

With reference to FIGS. 6 and 7, the bushing 42 disposed in the ram frame 12 preferably includes a collar assembly 96 for adjusting the position of the lower shaft portion 84LS relative to the punch axis PA within a limited range of adjustment. The collar assembly 96 includes an annular portion 98 having a central throughbore of a diameter selected relative to the diameter of the lower shaft portion 84LS such that the lower shaft portion is received in a relatively close fit in the central throughbore. The collar assembly 96 also includes an elliptical outer portion 100 having an elliptically shaped inner throughbore whose shorter radius is slightly larger than the diameter of the outer circumferential surface of the annular portion 98. The elliptical outer portion 100 includes four threaded throughbores 102, each centered on a respective 0°, 90°, 180°, and 270° radius of the axis of the annular portion 98. Each threaded throughbore 102 threadably receives a set screw 104, as seen in FIG. 6, for adjusting the position of the annular portion 98 within the elliptical outer portion 100 in a manner described in more detail below.

As seen in FIG. 6, the collar assembly 96 is fixedly mounted to the upper axial end of the body portion of the bushing 42 and the bottom surface of the elliptical outer portion 100 is supported on the ram frame 12 upon insertion of the bushing 42 into the ram aperture to thereby support the bushing 42 in suspended disposition in the ram aperture. After the lower shaft portion 84LS has been inserted through the central throughbore of the annular portion 98, the set screws 104 are threaded along their respective throughbores 102 as necessary to engage the annular portion 98 and move the annular portion relative to the elliptical outer portion 100 to thereby effect slight offset displacement of the axis of the lower shaft portion 84LS relative to the punch axis PA. This procedure allows for slight compensation in any remaining misalignment of the respective turret aperture 18,24 to be re-bored that was not or could not be corrected during the earlier dial indicator measurement procedure.

The procedure for installing the boring bar 84 in its operating position on the punch press machine 10 is as follows. If an upper turret aperture 18 on the upper turret 14 is to be re-bored, a die holder 92 is disposed at a lower turret aperture 24 which is positioned in general alignment with the upper turret aperture 18 to be re-bored and the bushing insert 88 is disposed on the die holder 92. Both the upper turret 14 and the lower turret 16 are locked against angular movement by their respective index pin assemblies 30,32. The bushing 42 is disposed in the ram aperture of the ram frame 12 and the lower shaft portion 84LS is inserted through the central throughbore of the annular portion 98 until the bottom axial end of the lower shaft portion extends slightly beyond the ram aperture. At this point, the cutting tool 58 is held at a position intermediate the ram frame 12 and the upper turret 14 with the cutter holder 60 coaxial with the lower shaft portion 84LS and the lower shaft portion is inserted through the inner bore 62 of the cutter holder 60, through the upper turret aperture 18 to be re-bored, and into the bushing insert 88. The cutting tool 58 is fixedly secured to the lower shaft portion 84LS by the tightening of a securement bolt 106, which extends through a countersunk radial bore 108 in the cutter holder 60, as seen in FIG. 8A. The bore 108 is preferably diametrically opposite one of the slots 64 for ease of angular aligning the slots 64 relative to the lower shaft portion 84LS.

The cutting tool 58 is secured to the lower shaft portion 84LS at a location slightly axially above the upper turret aperture 18. The top axial end of the lower shaft portion 84LS is coupled via the lower shaft coupling 86LC, as seen in FIG. 1, to the intermediate shaft portion 84IS and the top axial end of the intermediate shaft portion is coupled via the intermediate shaft coupling 86IC to the top shaft portion 84TS. The top shaft portion 84TS is operatively connected to a rotation drive device 108, which may be, for example, a drive motor of the type used in connection with vertical milling machines. The rotation drive device 108 is fixedly mounted to the top of the main frame of the punch press machine 10. The lower shaft coupling 86LC and the intermediate shaft coupling 86IC are preferably axially slidable along the adjacent shaft portions to facilitate removal of the intermediate shaft portion 84IS upon completion of a re-boring operation.

The cutting step of the re-boring procedure is as follows. If the three tool supports 70 of the cutting tool 58 have not previously been disposed at their selected removably fixed dispositions on the cutter holder 60 prior to insertion of the lower shaft portion 84LS through the cutting tool 58, the positioning of the tool supports 70 is undertaken upon completion of the installation of the boring bar 84. Preferably, one of the three tool supports 70 is positioned prior to the positioning of the other two tool supports and this first tool support 70 is positioned such that its cutting tip 70CT extends radially outwardly to a radial spacing equal to the radius of the new enlarged hole to be bored in the upper turret aperture 18. In positioning this first tool support 70, shims (not shown) may be disposed, as necessary, between the inside face of the tool support and the bottom face 68BF to increase the radial spacing of the cutting tip 70CT from the axis of the cutter holder 60.

Following the positioning of the first tool support 70, the other two tool supports 70 are positioned and secured in their respective tool support receiving regions 68 and, in this regard, the respective tool support 70 which is next to the first tool support 70 (as viewed in the direction opposite to the direction of rotation of the cutting tool 58) is disposed at a slightly lesser radial spacing than the first tool support 70.

After the cutting tool 58 has been fixedly secured to the lower shaft portion 84LS, the rotation drive device to which the top shaft portion 84TS is connected is actuated to rotate the boring bar and, thereby, to rotate the cutting tool 58. As the cutting tool 58 is rotated, the cutting tips 70CT remove metal from the upper turret aperture 18 and, in correspondence with the cutting action of the cutting tips, the boring bar 84 is progressively lowered to effect deeper and deeper cutting action by the cutting tool 58 until, ultimately, the cutting tips 70CT extend below the bottom axial end of the upper turret 14. Once the cutting tool 58 has been advanced completely through the upper turret 14, the rotation of the boring bar 84 is ceased and the boring bar is disassembled by, for example, initially uncoupling the lower coupling 86LC, loosening the cutting tool 58 from its secured position on the lower shaft portion 84LS, and then removing the lower shaft portion from the bushing insert 88 and the bushing 42. The arrangement of the couplings 86LC and 86IC permit relatively quick disassembly of the boring bar 84 so that the next step of the alignment restoring procedure can be undertaken.

The upper turret 18 through which the cutting tool 58 has just been advanced now has an enlarged diameter than its original factory diameter and, moreover, the axis of the enlarged turret aperture is substantially at a desired predetermined radial spacing from the center line CL (e.g., the axis of the enlarged turret aperture is substantially co-axial with the punch axis PA).

The now enlarged upper turret aperture 18 is again ready to receive and support a punch tool holder 20 and the upper turret 14 can be indexed to another upper turret aperture 18 for another cycle of the alignment restoring method. However, the present invention also contemplates that an additional optional procedure can be implemented to ensure a precise fit of a punch tool holder 20 in the upper turret aperture. This optional procedure involves the placement of a sleeve insert in the now-enlarged turret aperture specifically sized to receive a punch tool holder 20.

Figure 9:
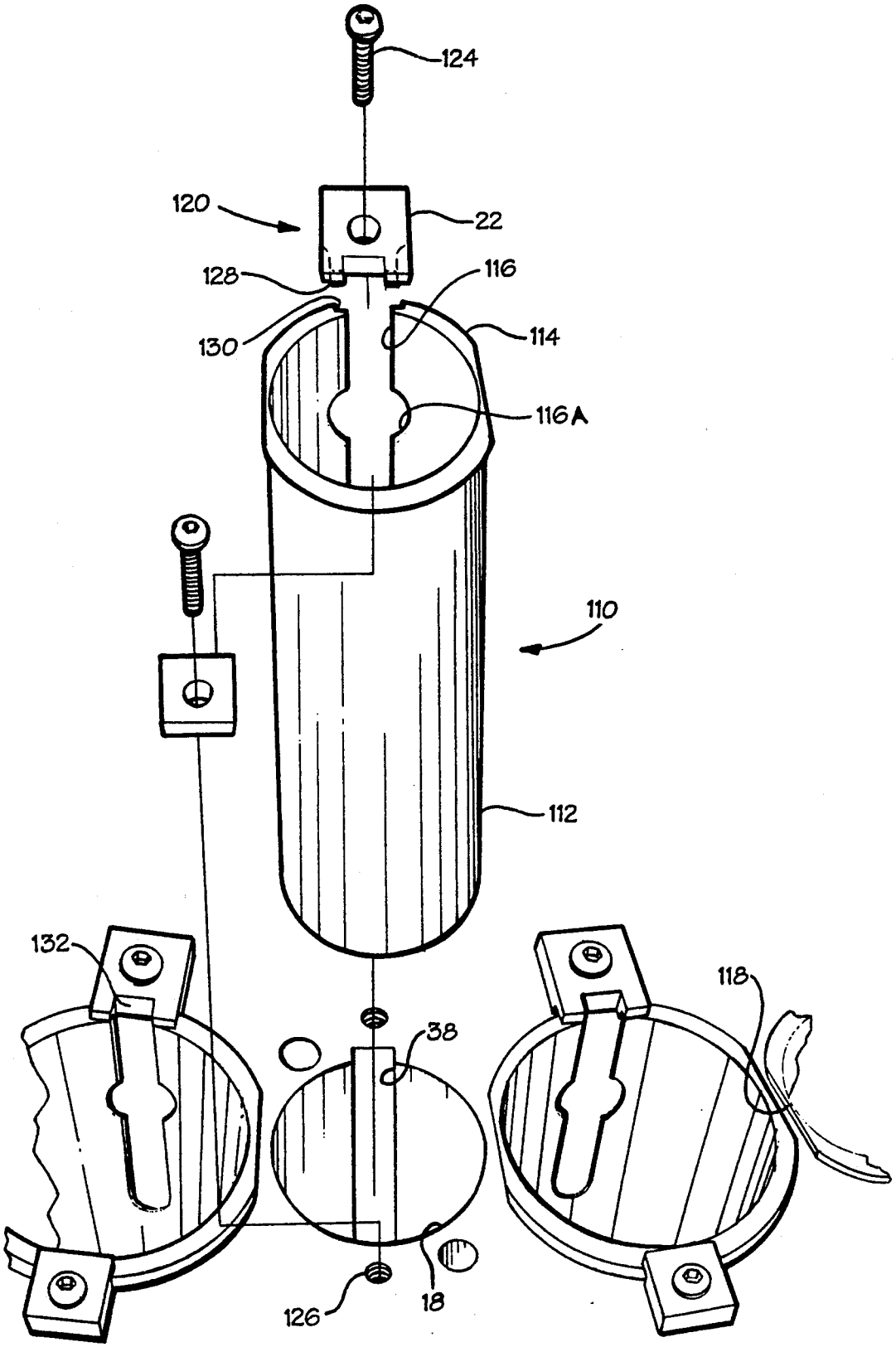
FIG. 9 is a schematic view of a portion of the upper turret of the punch press machine shown in FIG. 1 and showing, in exploded view, a sleeve of the present invention.

As seen in FIG. 9, following the enlargement of the turret apertures, each turret aperture such as, for example, an upper turret aperture 18, is provided with a sleeve insert 110 specifically dimensioned in correspondence with the enlarged turret aperture and the dimensions of a punch tool holder 20. The sleeve insert 110 is preferably formed of a durable metal and has an elongate cylindrical body portion 112 having an axial extent equal to the axial extent of the respective turret aperture in which the sleeve insert is received. Preferably, the sleeve insert 110 is hardened to at least the hardness of the punch tool holders 20 by any suitable conventional hardening method such as, for example, case hardening carbo-nitriding, or plating.

A flange portion 114 is formed at the top axial end of the elongate body portion 112 and extends circumferentially completely around the top of the elongate body portion unless a keyway 116 is optionally provided, in which event the flange portion 114 does not extend circumferentially over the keyway. The keyway 116 includes an enlarged area 116A to permit access to the spring biased pin (not shown) which is typically disposed in an upper turret aperture.

The elongate body portion 112 has an outer diameter substantially equal to the enlarged diameter of the turret aperture and the inner diameter of the elongate body portion is sized with respect to the outer diameter of a punch tool holder 20. Thus, the cylindrical sleeve 110 is received in a turret aperture in a close fitting relationship therewith and is adapted to receive a punch tool holder 20 in relatively close fitting relationship therewith. The bottom surface of the flange portion 114 is planar and is adapted to be supported on the top axial surface of the respective turret in which the sleeve insert 110 is received. In correspondence with the proximity of adjacent turret apertures to one another, the flange portion 114 can be provided with truncated side edges 118 to permit interference-free installation of the sleeve inserts 110 in adjacent turret apertures. The flange portion 114 minimizes the extent to which slag particles produced during a plasma burning operation can enter the upper turret aperture.

Each sleeve insert 100 is preferably fixedly secured to the turret of the respective aperture in which it is received and this may be accomplished by any appropriate fastening method. Preferably, each sleeve insert 110 is releasably fixedly secured in its respective turret aperture by a fastening assembly 120 which includes two or more hold down tabs 122 secured to the turret at circumferentially spaced locations around the flange portion 114. Each hold down tab 122 includes a throughbore through which a bolt 124 is received for threading engagement of the bolt in a threaded bore 126 formed in the respective turret. Each hold down tab 122 includes an overhang portion 124 adapted to extend over a portion of the flange portion 114 to apply compressive force to the flange portion against the turret and thereby cooperate with the other hold down tabs to maintain the sleeve insert 110 in its respective turret aperture. Additionally, it has been found that a hold down tab 122 of a modified design is particularly helpful in maintaining the keyway 116 of a sleeve insert 110 in its key receiving position. In this modified hold down tab 122, a pair of foot projections 128 are provided at a spacing from one another generally corresponding to the width of the top portion of a keyway 116. Each foot projection 128 is received in a notch 130 formed in the flange portion 114 of the sleeve insert upon installation of the hold down tab 122. The pair of foot projections 128 of the modified hold down tab 122 resists the action of any radially compressive forces on the respective sleeve insert 110 tending to narrow the widthwise extent of the keyway 116. As necessary, a recess 132 is formed between the foot projections 128 to permit axial movement of the key 40 of a punch tool holder 20 downwardly or upwardly past the hold down tab 122.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Method for aligning misaligned apertures of the turrets of a punch press machine, the punch press machine being of the type having a rotatable lower turret rotatable about a turret rotation axis and having a plurality of uniformly angularly spaced, through apertures each for supporting a die holder and having a circumference, a rotatable upper turret rotatable about the turret rotation axis and having a plurality of uniformly angularly spaced, through apertures each for receiving a punch holder therein and having a circumference, each punch holder supporting an axially movable punch and each die holder for supporting a die on which a workpiece is disposed for a punching operation, means for releasably maintaining a turret in a predetermined angular position, and a ram mounting assembly having a ram aperture and a ram received in the ram aperture for axially driving a punch supported at an upper turret aperture into contact with a workpiece disposed on the die of a lower turret aperture generally aligned with the upper turret aperture, the method comprising:

detecting the difference, between the radial spacing of the axis of a turret aperture and a predetermined radial spacing as measured from a reference axis;

detecting the difference between the angular position of the turret aperture axis and a predetermined angular position as measured relative to the reference axis;

adjusting the releasably maintaining means to maintain the turret having the detected turret aperture at a predetermined angular position in which the detected angular difference is reduced to a predetermined value; and enlarging the circumference of the detected turret aperture to an enlarged circumference whose axis lies substantially at the predetermined radial spacing, said enlarging the circumference of the detected turret aperture including disposing a first guide bearing in the ram aperture, disposing a second guide bearing in the respective turret not having the detected turret aperture, mounting a boring bar in the first and second guide bearings for guided rotational movement of the boring bar by the guide bearings, the boring bar being operable to support a cutting tool for a cutting operation in which material is removed from the turret having the detected turret aperture by the cutting tool moving relatively along the surface forming the detected turret aperture, and rotationally driving the boring bar to effect cutting of the turret by the cutting tool, thereby aligning the apertures of the turrets of said punch press machine.

2. Method for aligning the apertures of the turrets of a punch press machine according to claim 1 wherein the turret includes a registration location correlated with the detected aperture, the turret registration location being in registry with a selected angular reference location upon substantial coincidence with the turret aperture axis with the predetermined angular position, and the releasably maintaining means includes means for selectively engaging the turret and said adjusting the releasably maintaining means includes adjusting the selectively engaging means to engage the turret so as to maintain the registration location in registry with the predetermined angular reference location.

3. Method for aligning the apertures of the turrets of a punch press machine according to claim 2 wherein said selectively engaging means includes a member extendable radially inwardly to engage the turret and retractable radially outwardly to release the turret for further rotation and said adjusting the selectively engaging means includes changing the angular position of the member.

4. Method for aligning the apertures of the turrets of a punch press machine according to claim 1 wherein the detected turret aperture is an upper turret aperture and further comprising disposing a cylindrical sleeve in the enlarged diameter turret aperture for retaining a punch holder therein.

5. Method for aligning the apertures of the turrets of a punch press machine according to claim 4 wherein the detected turret aperture includes a radially outwardly extending keyway for receipt therein of a key formed on a punch holder and said disposing a cylindrical sleeve includes disposing a cylindrical sleeve having a keyway in the enlarged diameter turret aperture with the sleeve keyway in alignment with the turret aperture keyway.

6. Method for aligning the apertures of the turrets of a punch press machine according to claim 1 wherein said detecting the radial spacing and angular position differences includes detecting the radial and angular difference of the axis of a turret aperture relative to the axis of the ram.

7. Method for aligning the apertures of the turrets of a punch press machine according to claim 1 wherein the cutting tool includes a plurality of cutting tips each independently positionable at a predetermined radial spacing from the rotational axis of the boring bar and further comprising setting each cutting tip at a different radial spacing than the other cutting tips prior to said rotationally driving the boring bar.

* * * * *